US007038176B2

(12) United States Patent
Sterling

(10) Patent No.: US 7,038,176 B2
(45) Date of Patent: May 2, 2006

(54) INFINITE TEMPERATURE CONTROL FOR HEATING ELEMENT OF A COOKING APPLIANCE

(75) Inventor: Margaret M. Sterling, Madison, TN (US)

(73) Assignee: Maytag Corporation, Newton, IA (US)

( * ) Notice: Subject to any disclaimer, the term of this patent is extended or adjusted under 35 U.S.C. 154(b) by 107 days.

(21) Appl. No.: 10/784,974

(22) Filed: Feb. 25, 2004

(65) Prior Publication Data

US 2005/0184046 A1 Aug. 25, 2005

(51) Int. Cl.
*H05B 1/02* (2006.01)

(52) U.S. Cl. ..... 219/483; 219/507; 219/486; 219/443.1; 338/123

(58) Field of Classification Search ..... 219/483–486, 219/505, 507, 511, 443.1, 480, 470, 446.1; 338/134, 138

See application file for complete search history.

(56) References Cited

U.S. PATENT DOCUMENTS

| | | | | |
|---|---|---|---|---|
| 2,761,051 | A | 8/1956 | Dodson | |
| 2,804,531 | A | 8/1957 | Dadson | |
| 2,906,845 | A | 9/1959 | Turner | |
| 4,371,780 | A * | 2/1983 | Gossler et al. | 219/457.1 |
| 4,511,789 | A | 4/1985 | Goessler et al. | |
| 4,634,843 | A | 1/1987 | Payne | |
| 4,700,051 | A | 10/1987 | Goessler et al. | |
| 4,902,877 | A | 2/1990 | Grasso et al. | |
| 4,973,933 | A | 11/1990 | Kadlubowski | |
| 5,171,973 | A | 12/1992 | Higgins | |
| 5,191,190 | A | 3/1993 | Dodson | |
| 5,235,159 | A * | 8/1993 | Kornrumpf et al. | 219/486 |
| 5,841,112 | A | 11/1998 | Brooks et al. | |
| 5,864,121 | A | 1/1999 | Meyer et al. | |
| 6,018,149 | A | 1/2000 | Higgins | |
| 6,111,231 | A | 8/2000 | Corson et al. | |
| 6,198,080 | B1 | 3/2001 | Rice et al. | |
| 6,781,097 | B1 * | 8/2004 | Graff | 219/492 |
| 2002/0014482 | A1 | 2/2002 | Becker et al. | |
| 2002/0185490 | A1 * | 12/2002 | Kirby | 219/507 |

* cited by examiner

*Primary Examiner*—Mark Paschall
(74) *Attorney, Agent, or Firm*—Diederiks & Whitelaw, PLC

(57) ABSTRACT

A cooking appliance includes a cooktop having at least one heating zone having first and second heating elements and a control element for setting a desired cooking temperature for the heating zone. When the control element is rotated in a first direction, only the first heating element will be activated and, when rotated in a second direction, both the first and second heating elements are activated. The control element includes a variable resistor that changes resistance as the control element is rotated through nearly 360° to alter the operational state of the heating element(s). A controller senses the change in resistance and determines in which direction the control element is rotated so as to activate the appropriate heating element(s).

20 Claims, 2 Drawing Sheets

INFINITE TEMPERATURE CONTROL FOR HEATING ELEMENT OF A COOKING APPLIANCE

BACKGROUND OF THE INVENTION

1. Field of the Invention

The present invention pertains to the art of cooking appliances and, more particularly, to an infinite temperature control element for selectively operating a heating zone arranged on a cooking appliance cooktop.

2. Discussion of the Prior Art

Infinite temperature controls are known in the art of cooking appliances for controlling heating elements or zones arranged on cooktops of the cooking appliances. Typically, a control element or knob is rotated from an "off" position, across a temperature selection zone, to establish a desired operating temperature for a heating element. The temperature zone ranges from a low setting, positioned in a beginning portion of the rotation of the control knob, to a maximum setting positioned at an end portion of the rotation of the control knob. That is, the control knob provides infinite adjustment over a finite range so that the control knob actually rotates over a range of less than 360°.

In other arrangements, a cooking appliance can actually rotate through 360°. The control knob can either be rotated in a first direction to pass over the full temperature range, starting from a low setting and leading to a maximum setting, or the control knob can be rotated in a second direction to pass over the full temperature range, starting at the maximum setting and leading to the low setting. In many cases, the low setting is achieved by activating a single heating element, and the maximum setting is achieved by activating multiple heating elements.

For example, as shown in the one prior art arrangement illustrated in FIG. 1, it is known to rotate a control knob 2 counterclockwise from an off position 3 to initially set a low setting for a heating zone by activating a center heating element 4. Continued rotation of knob 2 raises a temperature of heating element 4 until additional heat is required, thus activating a second heating element 5. Further rotation of knob 2 causes a third heating element 6 to be activated to establish the maximum setting. Knob 2 can be continually rotated counterclockwise to an off position 3 or rotated clockwise back to off position 3. Alternatively, a consumer can elect to go straight from off position 3 to the maximum setting by simply rotating knob 2 in a clockwise direction. In any case, while effective at operating various heating elements 3–6, the overall adjustment scale is somewhat limited. In other words, the scale is not sensitive enough to enable precise control over the entire heating zone.

Based on the above, there still exists a need for a control element for a cooking appliance that provides a great degree of control over the operation of multiple heating elements associated with a particular heating zone. More specifically, there exists a need for a control element that, when rotated in a first direction, provides a large adjustment range for only one heating element and, when rotated in a second direction, provides a large adjustment range for multiple heating elements.

SUMMARY OF THE INVENTION

The present invention is directed to a cooking appliance including a top surface which defines a cooktop. The cooktop includes at least one selectively controllable heating zone and an associated control element. More specifically, the heating zone includes first and second heating elements, with the control element being associated with establishing a desired temperature level for the heating zone.

In accordance with a preferred embodiment of the invention, the control element includes a home position and a temperature adjustment zone for establishing a desired cooking temperature for the heating zone. More specifically, rotation of the control element from the home position, across the temperature adjustment zone, in a first direction activates only the first heating element and, rotation of the control element from the home position, across the temperature adjustment zone, in a second direction activates both the first and second heating elements. In either case, the particular orientation of the control element relative to the temperature adjustment zone can establish a desired temperature of the first heating element or both the first and second heating elements.

In accordance with the most preferred embodiment of the invention, the cooking appliance includes a microcontroller operatively connected to the control element, and first and second relays operatively connected between a microcontroller and the first and second heating elements respectively. More specifically, the control element includes a variable resistor that changes resistance as the control element is rotated. In order to determine in which direction the control element is being rotated, the microcontroller senses the direction of the change in resistance of the variable resistor. If the microcontroller senses rotation in the first direction, the first relay is activated to operate only the first heating element and, if the microcontroller senses rotation in the second direction, both the first and second relays are activated to operate both the first and second heating elements. In this manner, activation of the first and second heating elements is strictly based upon the rotational direction of the control knob, while enabling nearly 360° of infinite variable adjustment of the heating element(s) in the temperature adjustment zone. As stated above, the relative position of the control knob in the temperature adjustment zone sets the temperature output from the activated heating element(s).

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 2:
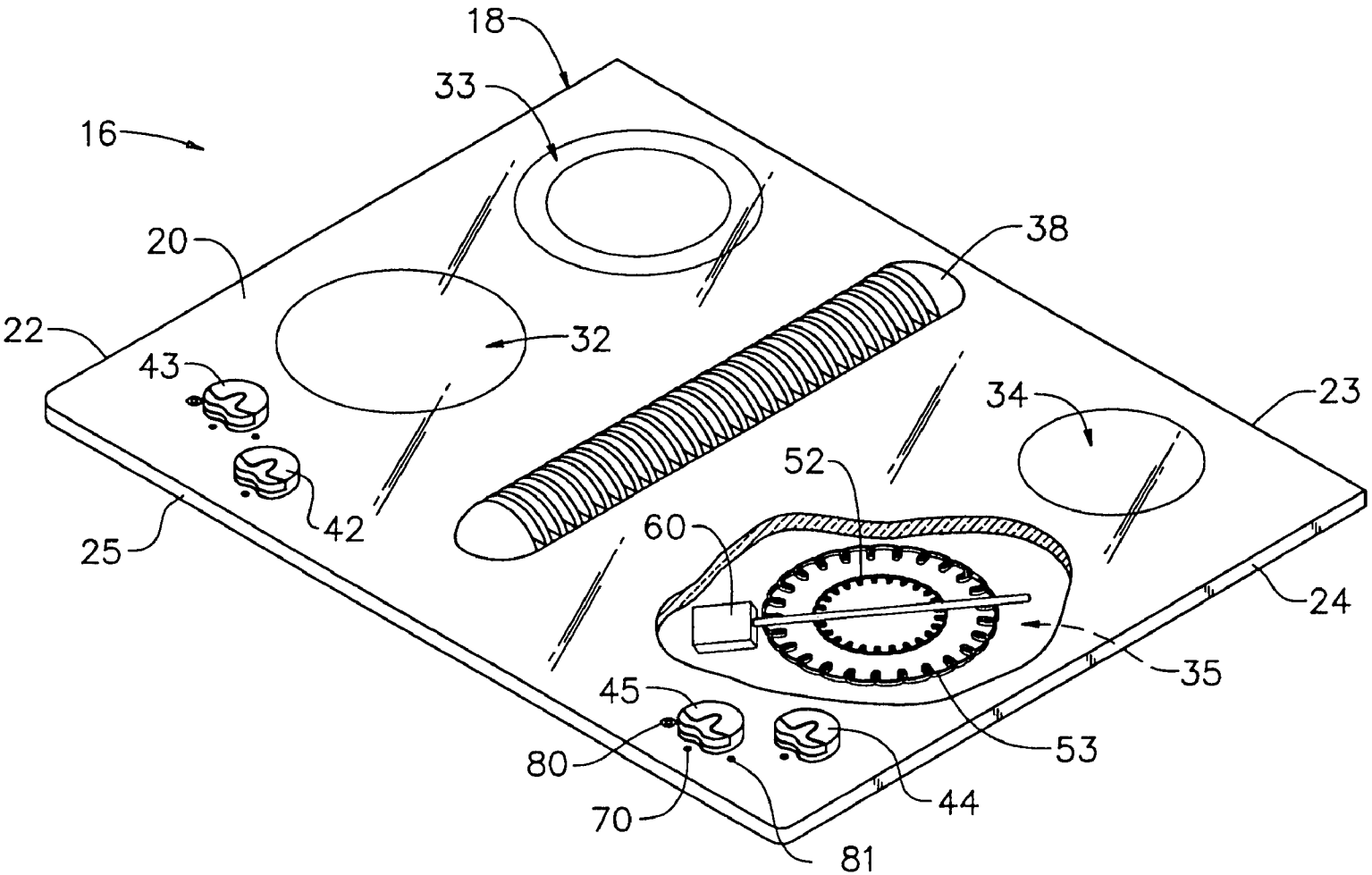
FIG. 2 is a perspective, partially cut-away view of a smooth surface cooktop employing an infinite temperature control element constructed in accordance with the present invention.

With initial reference to FIG. 2, a cooking appliance constructed in accordance with the present invention is generally shown at 16. Although the actual cooking appliance into which the present invention may be incorporated can vary, the invention is shown in connection with cooking appliance 16 depicted as a smooth surface cooktop 18. However, it should be understood that the present invention is not limited to this particular configuration and can be incorporated into various types cooking appliances, including free standing ranges, slide-in ranges and the like. In the embodiment shown, cooktop 18 includes a top surface 20, defined by outer peripheral edge portions 22–25, having arranged there about a plurality of cooking zones 32–35.

In a manner known in the art, a downdraft fan unit 38 is shown centrally positioned upon top surface 20 between the plurality of cooking zones 32–35. In general, downdraft fan unit 38 is provided to remove smoke and/or other food effluents generated during a cooking process. As further shown in FIG. 2, cooking appliance 16 includes a plurality of control elements or knobs 42–45 each associated with a respective one of the plurality of cooking zones 32–35. As will be discussed more fully below, control knobs 42–45 establish particular temperature settings for each of the corresponding cooking zones 32–35.

In accordance with the embodiment shown, cooking zones 33 and 35 actually constitute dual element cooking zones, each having a first heating element 52 and a second heating element 53. In addition, each of cooking zones 32–35 is provided with a thermostat, such as indicated at 60. Since the operation of cooking zones 33 and 35 are identical, a description will be made with reference to cooking zone 35 and it is to be understood that cooking zone 33 is operated in a corresponding manner. In order to control first and second heating elements 52 and 53 of cooking zone 35, control knob 45 is rotatable in both a first or clockwise (CW) direction and a second or counterclockwise (CCW) direction. That is, in the preferred embodiment shown, rotating control knob 45 in a CCW direction will activate first heating element 52 and rotating control knob 45 in a CW direction will activate both heating elements 52 and 53 in order to establish a particular temperature for cooking zone 35.

Figure 1:
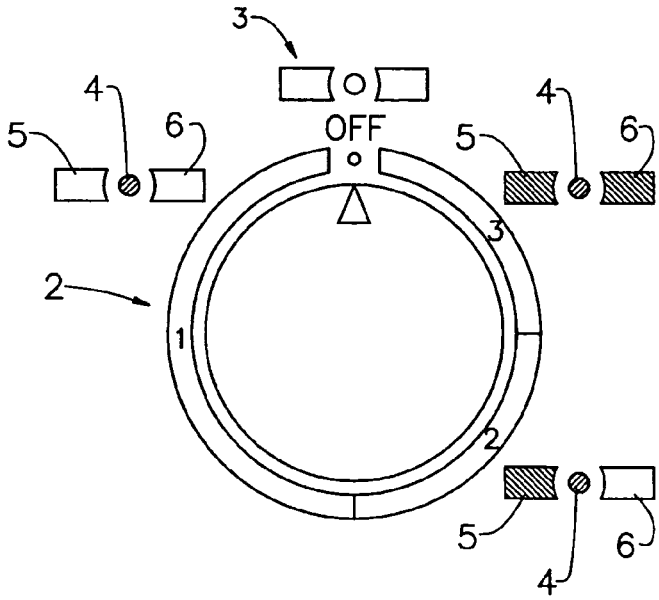
FIG. 1 (PRIOR ART)
FIG. 1 is a detail view of a control element for a cooking appliance constructed in accordance with the prior art.
Figure 3:
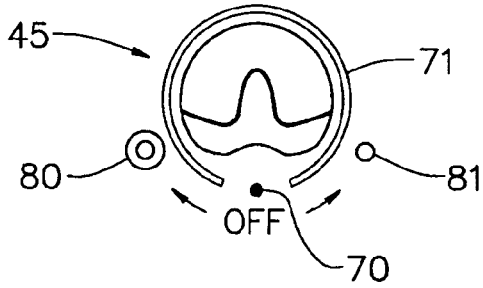
FIG. 3 is a detail view of the infinite temperature control element of FIG. 2.

As best seen in FIG. 3, control knob 45 includes a home or off position 70 and a temperature adjustment range or zone 71. When rotated in a counterclockwise direction from home position 70, control knob 45 will gradually increase the heat output of only first heating element 52 from an initial low setting to a maximum setting as control knob 45 rotates through temperature adjustment zone 71. When it is desired to turn off or deactivate heating element 52, control knob 45 can either be rotated back through temperature adjustment zone 71 to home position 70 or, alternatively, rotated further CCW directly to home position 70. With this arrangement, heating element 52 is always activated at an initial low setting, can be set through a nearly 360° infinitely adjustable range and may be deactivate by rotating control knob 45 in either direction.

In a similar manner, when control knob 45 is initially rotated CW from home position 70, both heating elements 52 and 53 will be simultaneously operated, initially at a low power setting. Further rotation of control knob 45 through temperature adjustment zone 71 will function to regulate a desired setting for both heating elements 52 and 53. So long as control knob 45 does not pass through home position 70, control knob 45 can be shifted within temperature adjustment zone 71 to alter the operating state of each of heating elements 52 and 53. Therefore, control knob 45 can be rotated nearly 360° to provide a wide range of infinitely variable heat settings for heating elements 52 and 53. When it is desired to deactivate both heating elements 52 and 53, control knob 45 can be rotated in either direction to home position 70.

In other words, once a particular heating element(s) 52 or 52 and 53 has been activated, rotation of control knob 45 controls only the heat output of that particular element until control knob 45 is returned to off or home position 70. Thus, if control knob 45 is rotated from home position 70, clockwise through temperature zone 71, both first and second heating elements 52 and 53 are activated and their heat output altered as control knob 45 travels through temperature adjustment zone 71. In further accordance with the invention, when control knob 45 is rotated in the clockwise direction to activate both heating elements 52 and 53, a visual display 80 is illuminated. On the other hand, when control knob 45 is initially rotated from home position 70 in the counterclockwise direction to activate heating element 52, a display 81 will be illuminated.

Figure 4:
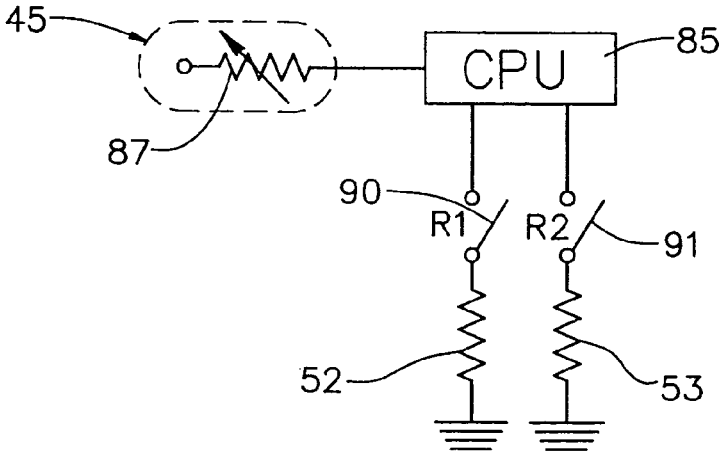
FIG. 4 is a schematic view of a control for the infinite temperature control element of FIG. 2.

In accordance with the most preferred form of the invention as particularly shown in FIG. 4, cooking appliance 16 includes a CPU or microcontroller 85 operatively connected to control knob 45 and heating elements 52 and 53. As shown, control knob 45 includes an associated variable resistor 87. In the most preferred form of the invention, as control knob 45 rotates about temperature selection zone 71, a resistance of variable resistor 87 either increases or decreases depending upon the particular direction of rotation of control knob 45. Thus, CPU 85 can determine the particular direction of rotation based on the change of resistance of variable resistor 87. If for example, control knob 45 is rotated in a counterclockwise direction, CPU 85, noting the change in resistance, will close a relay 90 to activate first heating element 52. Alternatively, if control knob 45 is rotated in a clockwise direction, CPU 85, noting the change in resistance, will activate both first relay 90 and a second relay 91 to initiate operation of both heating elements 52 and 53. Thus, the present invention allows for a large adjustment range for setting a particular temperature of cooking zone 35 when activating either first heating element 52 or first and second heating elements 52 and 53.

Although described with reference to a preferred embodiment of the present invention, it should be readily apparent to one of ordinary skill in the art that various changes and/or modifications can be made to the invention without departing from the spirit thereof. For instance, while the cooking appliance is shown to include two dual element heating zones, fewer or additional dual element heating zones could be used, with each having a corresponding infinite control knob. In addition, the particular direction of rotation, i.e., counterclockwise or clockwise, described above for the single or dual heating element operation is for exemplary purposes only. Furthermore, cooking appliance 2 is shown to include LEDs for indicating the particular operational status of the cooking zone, it should be understood that various other indicators, such as colored graphics, alpha-numeric displays and the like would be equally acceptable. Finally, it should be realized that the particular type of control knob or element employed could greatly vary without departing from the invention. In general, the invention is only intended to be limited to the scope of the following claims.

I claim:

1. A cooking appliance comprising:

a cooktop;

a plurality of heating zones arranged on the cooktop, at least one of said plurality of heating zones including a first heating element and a second heating element; and a control element operatively connected to each of the first and second heating elements and movable from a home position through a temperature adjustment zone, wherein initial movement of the control element from the home position in a first direction activates only the first heating element at an initial temperature, with continued movement in the first direction increasing an operating temperature of the first heating element and, initial movement of the control element from the home position in a second direction activates both the first and second heating elements at an initial temperature, with continued movement in the second direction increasing a combined operating temperature of the first and second heating elements such that said control element is movable through the temperature adjustment zone to regulate operation of the first heating element or both the first and second heating elements respectively.

2. The cooking appliance according to claim 1, wherein movement of the control element through the temperature adjustment zone back to the home position deactivates the at least one of the plurality of the heating zones.

3. The cooking appliance according to claim 1, further comprising:

a controller operatively connected to the control element; and first and second relays operatively connected to the first and second heating elements respectively, wherein the controller activates the first relay when the control element is moved in the first direction and both the first and second relays when the control clement is moved in the second direction.

4. The cooking appliance according to claim 3, wherein the control clement includes a variable resistor, said controller being adapted to detect whether the control element is moved in the first or second direction based upon a change in resistance of the variable resistor.

5. The cooking appliance according to claim 1, wherein the second heating element is arranged about the first heating element.

6. The cooking appliance according to claim 1, further comprising: a display for indicating operation of at least one of the first heating element or both the first and second heating elements.

7. The cooking appliance according to claim 1, wherein the control element is rotatable through the temperature adjustment zone.

8. The cooking appliance according to claim 7, wherein the control element is rotatable through nearly 360° in the temperature adjustment zone to regulate operation of either the first heating element or both the first and second heating element.

9. A cooking appliance comprising:

a cooktop;

a plurality of heating zones arranged on the cooktop, at least one of said plurality of heating zones including a first heating element and a second heating element; and control means operatively connected to each of the first and second heating elements and movable from a home position through a temperature adjustment zone, wherein initial movement of the control means from the home position in a first direction activates only the first heating element at an initial temperature, with continued movement in the first direction increasing an operating temperature of the first heating element and initial movement of the control means from the home position in a second direction activates both the first and second heating elements at an initial temperature, with continued movement in the second direction increasing a combined operating temperature of the first and second heating elements such that said control means is movable through the entire temperature adjustment zone to regulate operation of the first heating element or both the first and second heating elements respectively.

10. The cooking appliance according to claim 9, wherein the control means is movable through the temperature adjustment zone back to the home position to deactivate the at least one of the plurality of heating zones.

11. The cooking appliance according to claim 9, further comprising:

a controller operatively connected to the control means; and first and second relay means operatively connected to the first and second heating elements respectively, wherein the controller activates the first relay means when the control means is moved in the first direction and both the first and second relays when the control element is moved in the second direction.

12. The cooking appliance according to claim 11, wherein the control means includes a variable resistor, said controller being adapted to detect whether the control means is moved in the first or second direction based upon a change in resistance of the variable resistor.

13. The cooking appliance according to claim 9, wherein the second heating element is arranged about the first heating element.

14. The cooking appliance according to claim 9, further comprising: a display for indicating operation of at least one of the first heating element or both tho first and second heating elements.

15. The cooking appliance according to claim 9, wherein the control means is rotatable through the temperature adjustment zone.

16. The cooking appliance according to claim 15, wherein the control element is rotatable through nearly 360° in the temperature adjustment zone to regulate operation of either the first heating element or both the first and second heating elements.

17. A method of operating a heating zone having first and second heating elements on a cooktop of a cooking appliance comprising:

shifting a control element from a home position into a temperature adjustment zone;

sensing a direction of movement of the control element from the home position;

activating only the first heating element if the control element is shifted in a first direction and activating both the first and second heating elements if the control element is shifted in a second direction; and enabling temperature control for either the first heating element or both of the first and second heating elements, depending upon the direction of movement of the control element, throughout the entire temperature adjustment zone until the control element is repositioned in the home position with initial movement of the control element in the first direction activating the first heating element at an initial temperature, with continued movement in the first direction increasing an operating temperature of the first heating element and initial movement of the control element in the second direction activating both the fist and second beating elements at an initial temperature, with continued movement in the second direction increasing a combined operating temperature of the first and second heating elements.

18. The method of claim 17, wherein sensing the direction of movement of the control element includes detecting changes in resistance of a variable resistor operatively connected to the control element.

19. The method of claim 18, further comprising:

activating a first relay to operate the first heating element if the control element is shifted in the first direction; and activation both the first relay and a second relay to operate both of the first and second heating elements if the control element is shifted in the second direction.

20. The method of claim 17, further comprising: displaying an operational state of at least one of the first and second heating elements.

* * * * *